US007047765B2

(12) United States Patent
Gonzalez

(10) Patent No.: US 7,047,765 B2
(45) Date of Patent: May 23, 2006

(54) UNIVERSAL EAR ATTACHMENT FOR EARRINGS

(75) Inventor: Carlos M. Gonzalez, Fairfax, VA (US)

(73) Assignee: Kemango USA, Inc., Fairfax, VA (US)

( * ) Notice: Subject to any disclaimer, the term of this patent is extended or adjusted under 35 U.S.C. 154(b) by 90 days.

(21) Appl. No.: 10/643,850

(22) Filed: Aug. 20, 2003

(65) Prior Publication Data

US 2005/0039489 A1 Feb. 24, 2005

(51) Int. Cl.
*A44C 25/00* (2006.01)
*A44C 7/00* (2006.01)
*A44C 13/00* (2006.01)

(52) U.S. Cl. ..... 63/40; 63/12; 63/1.11

(58) Field of Classification Search ..... 63/40, 63/1.11, 12, 14.4–14.9
See application file for complete search history.

(56) References Cited

U.S. PATENT DOCUMENTS 3,418,826 A * 12/1968 Wieshuber ..... 63/13
4,653,292 A * 3/1987 Maupin et al. ..... 63/12
4,793,155 A * 12/1988 Law ..... 63/40
4,899,556 A * 2/1990 Ford ..... 63/14.1
5,048,311 A * 9/1991 Mastrobuono ..... 63/12
5,170,641 A * 12/1992 DiDomenico ..... 63/1.17
5,337,584 A * 8/1994 Angeli ..... 63/1.17
5,379,611 A * 1/1995 Impagliazzo ..... 63/14.1
5,438,850 A * 8/1995 Keating et al. ..... 63/20
5,598,926 A * 2/1997 Vogt ..... 206/457
RE35,511 E * 5/1997 Nakamura ..... 63/14.1
5,743,113 A * 4/1998 Kogen ..... 63/12
5,828,757 A * 10/1998 Michalsen et al. ..... 381/328
6,026,658 A * 2/2000 Weller ..... 63/1.11
6,105,392 A * 8/2000 Biagi ..... 63/12
6,138,333 A * 10/2000 Hollingworth ..... 24/705

* cited by examiner

*Primary Examiner*—Robert J. Sandy
*Assistant Examiner*—David Reese

(57) ABSTRACT

The present invention is generally related to a device for facilitating the setting of the ear attachment method on earrings. The device is comprised of a universal female clipping connector and a variety of male clipping connectors. The universal female connector is attached to the back of the earrings, then the user selects what kind of ear attachment method is desired and chooses a male clipping connector that will provide this method and such male connector is attached to the universal female connector creating earrings which can be then used by the method provided by the male connector.

3 Claims, 7 Drawing Sheets

UNIVERSAL EAR ATTACHMENT FOR EARRINGS

BACKGROUND OF THE INVENTION

At present time when jewelers create a pair of earrings, they have to make a usually non-reversible decision about the method by which the earrings are going to be attached to the ears. The earrings are either made to be used on pierced ears or made to be used with clips. A common solution for this problem has been to create one or more pairs for pierced ears and one or more pairs to be clipped. If the jeweler is good at estimating future demand, he/she will create the correct amount of pierced and the correct amount of clipped to satisfy his/her customer demands. But, as we all know, with this estimation it is very difficult to be precise, and even more so if the earrings are going to the market for the first time. When the earrings are expensive, the estimation becomes very important. A jeweler having the right customer and the right earrings, but the wrong ear attachment becomes very frustrated when he/she loses business solely because of this factor. The jeweler has to make the earrings for one type of earring attachment and hope that he/she has made the right decision.

To overcome these shortcomings of existing options, the present invention is developed to produce an effective means to facilitate the creation of earrings with the right type of ear attachment all the time. The invention described here will provide simple means of creating different kinds of earring attachments.

The flexibility of our universal earring clip device will ensure that no matter what the customer needs as an earring attachment this need is met. This is accomplished because the universal earring clip device easily conforms to the customer's needs with a minimum of effort on the jeweler or person assembling the earrings for the final customer.

SUMMARY OF THE INVENTION

The present invention is a device for facilitating the setting of the ear attachment method on earrings. Examples of ear attachment methods are: a post (A pin-like finding attached to an earring. It passes through the pierced earlobe, and may be held in place by a back) depicted in FIG. 1 number 11, a clip-back (works like a hinge to secure the earring to the earlobe) depicted in FIG. 2, a European wire (A curved wire which passes through the earlobe of a pierced ear and clasps shut) depicted in FIG. 3, and a hook ear wire (A fishhook-shaped finding with the hook end passing through the pierced ear) depicted in FIG. 4. This is not an exhaustive list of clipping methods, but a list of the most common ones today.

The device in this invention is comprised of a universal female clipping connector and a variety of male clipping connectors. The universal female connector is attached to the back of the earring (depicted in FIG. 5 number 3 and in number 6 FIGS. 6 and 7), by means of soldering or gluing it to the earring. This is the only process the manufacturer has to do with the earring. The earring designer should be aware of the size and position of the universal female connector while designing his/her earring. The earring with the universal female attached to its back can now be shown to the customer depicted in FIG. 5 number 1. Once the final user of the earring selects the ear attachment method that he/she is going to want on the earrings, the jeweler then will select the male clipping connector that implements the customer selection.

The jeweler will then proceed to insert the selected male connector into the universal female connector and lock it in place. To lock the male connector in place, a pin-like rod (depicted in FIG. 1 number 20) is inserted through the aligned holes of the universal female connector and the selected male connector, then bent to lock in place (depicted in number 5 FIGS. 6 and 7). This will create the earrings wanted by the customer as well as the desired ear attachment method. If the customer changes his/her mind and decides not to buy the earrings or wants a different ear attachment method, all the jeweler has to do is unlock and remove the male connector from the universal female connector, leaving the earring ready to recipe another male connector. The locking mechanism described in this specification is an example of a variety of mechanisms that could be used.

Other mechanisms that could be used include: a universal female connector that has the threads of a nut and the male connector with the matching threads of a bolt that can be tightened together; a universal female connector with a hole that locks by inserting the male connector latching part through a spring-lock mechanism.

BRIEF DESCRIPTION OF THE DRAWINGS

Other objects and advantages of the invention will become more apparent from the specification taken in conjunction with the accompanying drawings, in which.

DETAILED DESCRIPTION OF THE INVENTION

Figure 2:
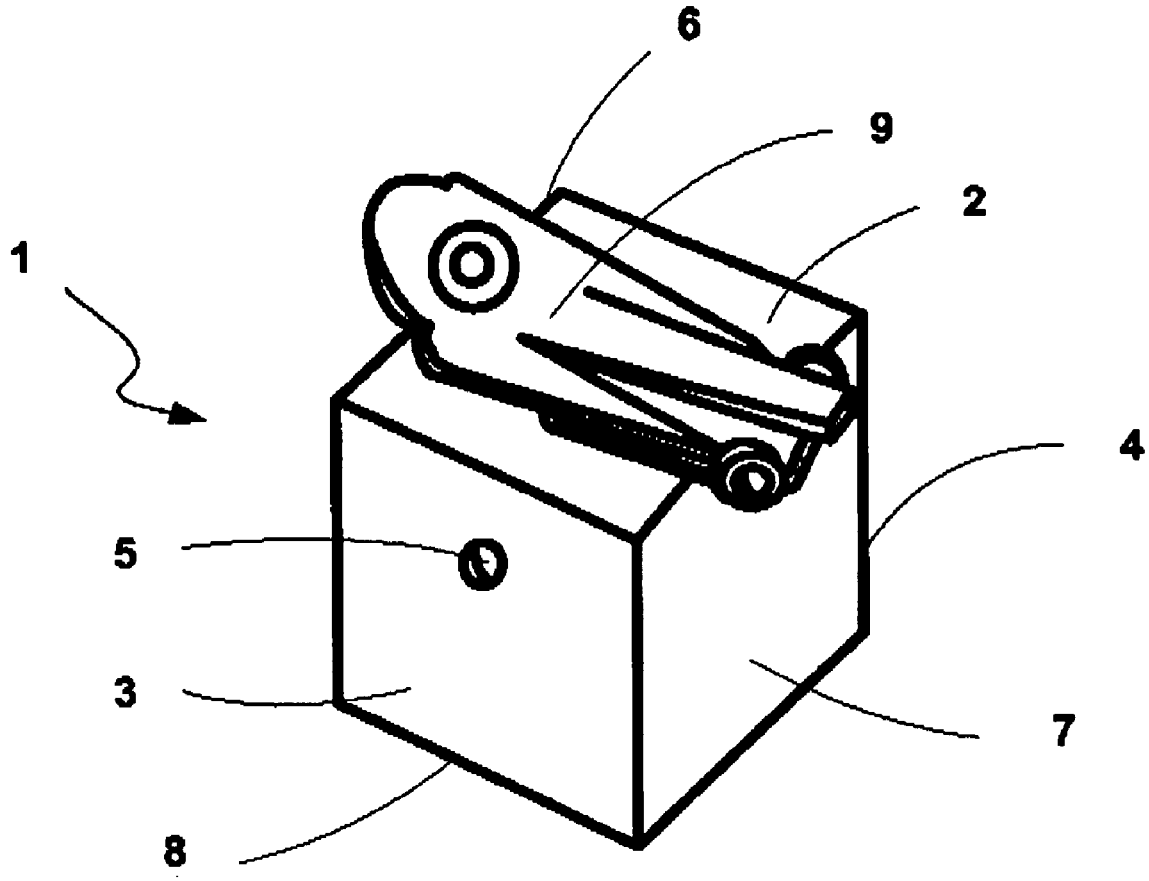
FIG. 2 is a perspective view of a male connector that implements the clip-back method for attaching an earring to an ear.
Figure 3:
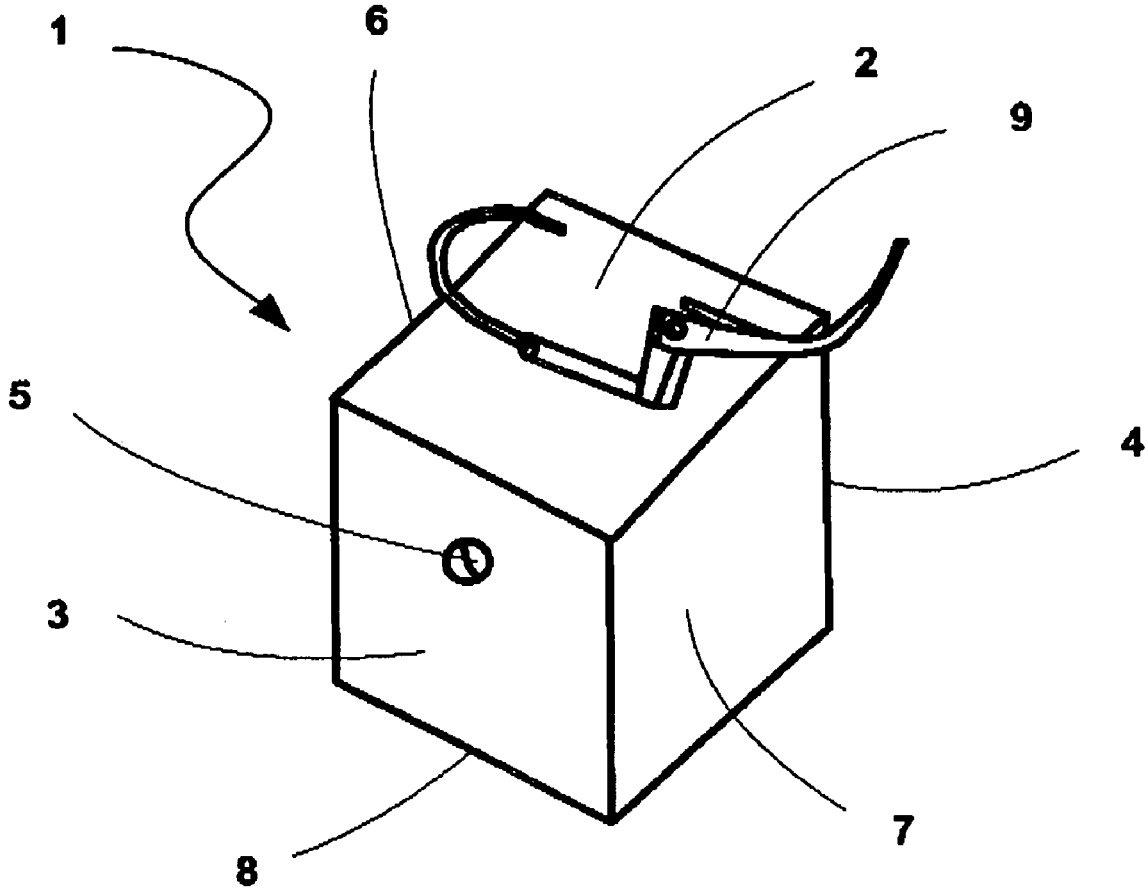
FIG. 3 is a perspective view of a male connector that implements the European wire method for attaching an earring to an ear.
Figure 4:
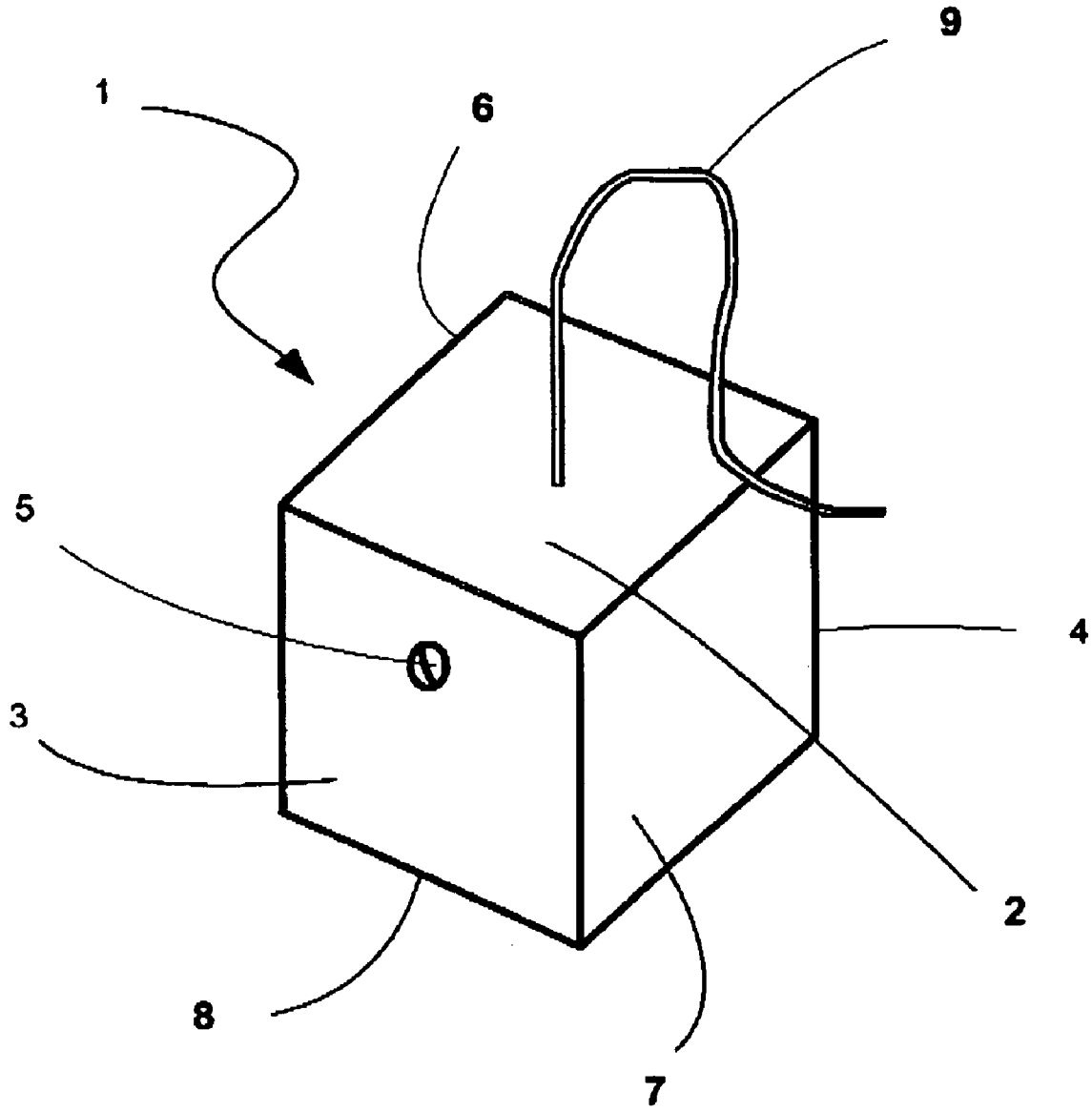
FIG. 4 is a perspective view of a male connector that implements the hook ear wire method for attaching an earring to an ear.

A device to facilitate the setting of the ear attachment method on earrings. The device is comprised of one universal female connector depicted in FIG. 1, and one male connector which can be selected from a set of male connectors where each one provides a method for attaching an earring to the ear, these connectors are depicted in FIGS. 2, 3, and 4.

Figure 1:
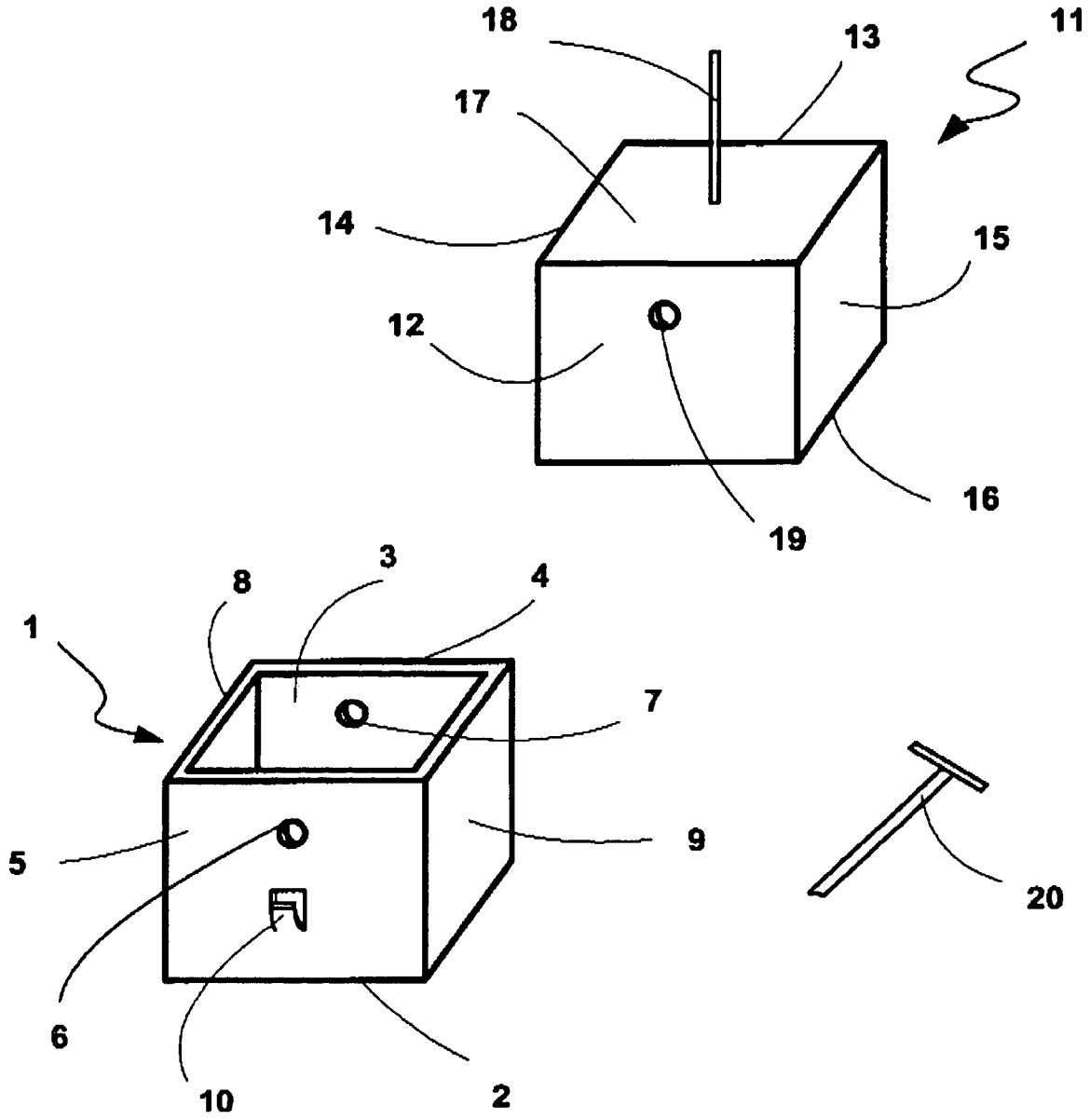
FIG. 1 is a perspective view of a universal female connector and a male connector that implements the post method for attaching an earring to an ear.
Figure 5:
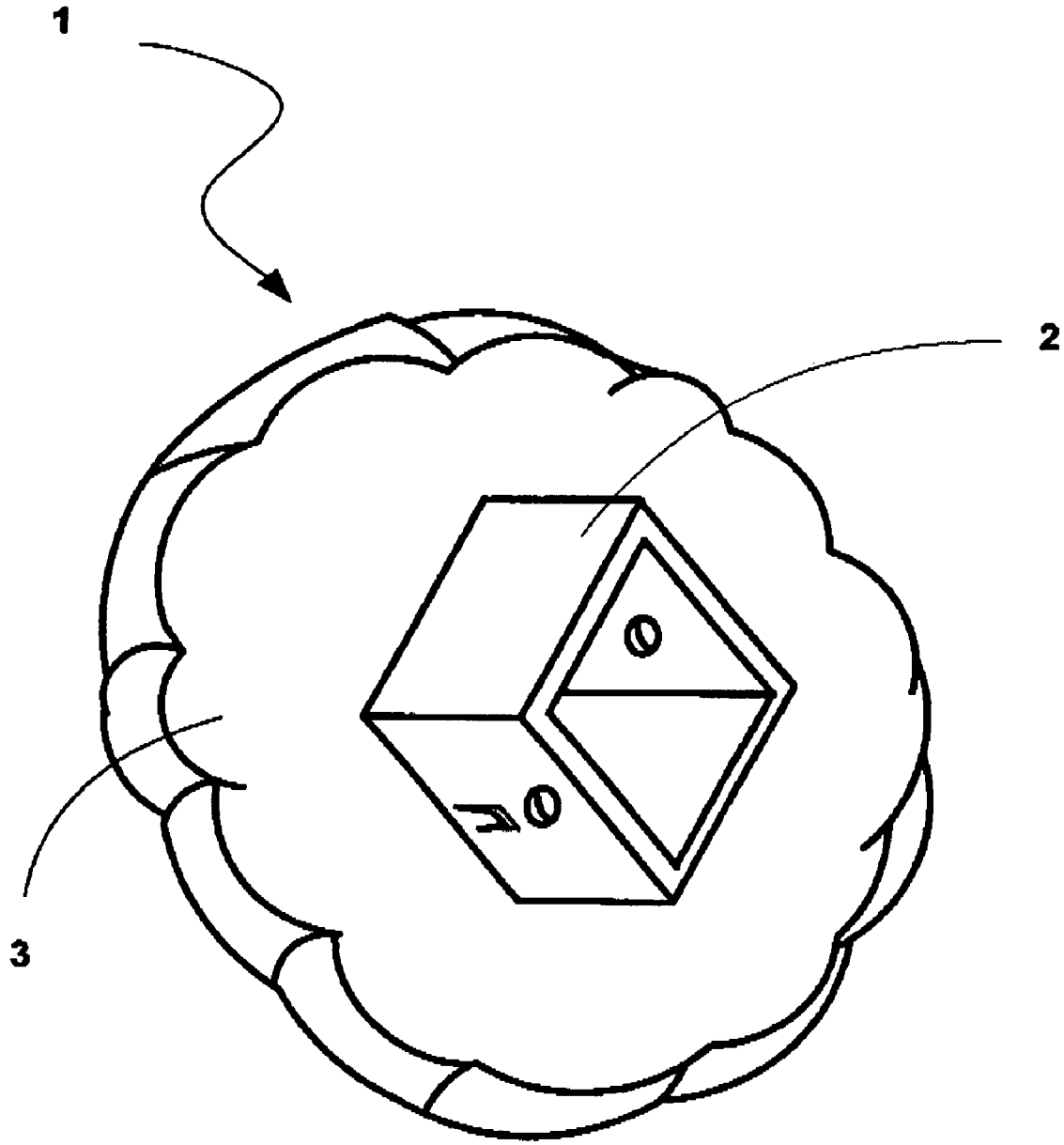
FIG. 5 is a perspective view of a universal female connector attached to the back of an earring.

A universal female connector depicted in FIG. 1 is attached to the back of an earring like it is depicted in FIG. 5. This attachment is done with the idea of creating a permanent long term attachment, therefore the attachment would be done, for example, by soldering or gluing the universal female connector to the earring. The universal female connector depicted in FIG. 1 is of a general cubic form in which one of the sides is left hollow and the other sides form an empty cube, which is the female connector's receptacle. The side that is attached to the earring (numbered 2) is solid and opposite to the side (numbered 3) which is an empty side that, together with all the other perpendicular sides (numbered 4, 5, 8 and 9) to this side, generate the female receptacle of the universal female connector. The universal female connector has on two of its opposite sides (numbered 4 and 5), holes (numbered 6 and 7) that are horizontally aligned. Below one of the holes and following a perpendicular line from the top is located the closing receptacle (numbered 10).

The male connector is of a general cubic form in which one of the sides is left hollow and the other sides form an empty cube (FIGS. 2, 3, 4, and 1 number 11) comprised of a top side on which the specific attachment method is implemented (FIG. 2 number 2, FIG. 3 number 2, FIG. 4 number 2, FIG. 1 number 17), two perpendicular and opposite sides (FIG. 2 numbers 8 and 9, FIG. 3 numbers 8 and 9, FIG. 4 numbers 8 and 9, FIG. 1 numbers 14 and 15), and two other perpendicular and opposite sides (FIG. 2 numbers 3 and 4, FIG. 3 numbers 3 and 4, FIG. 4 numbers 3 and 4, FIG. 1 numbers 12 and 13) having holes (FIG. 2 numbered 5 and 6, FIG. 3 numbered 5 and 6, FIG. 4 numbered 5 and 6, FIG. 1 numbered 19) that are horizontally aligned.

Figure 6:
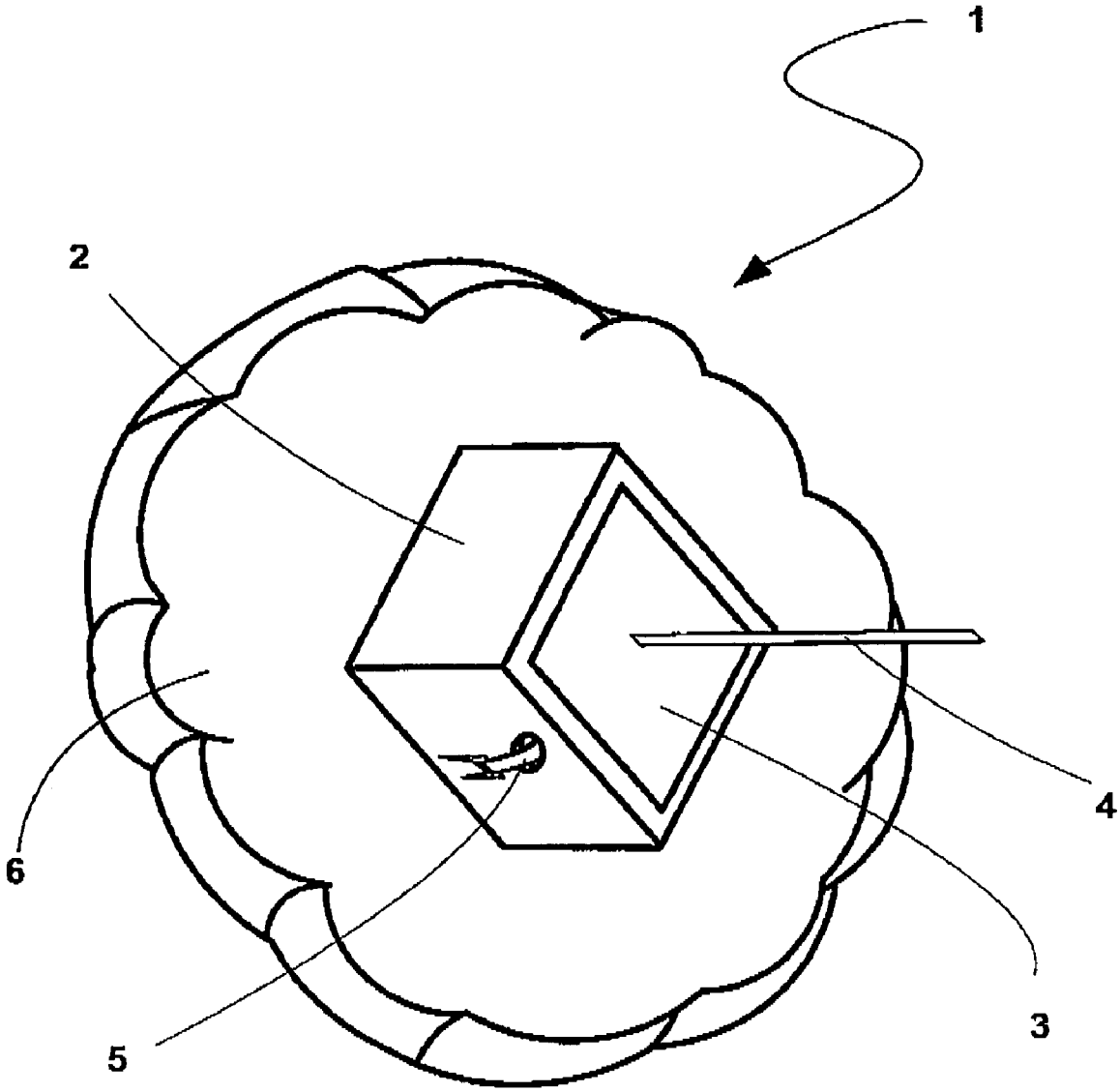
FIG. 6 is a perspective view of an earring with a universal female connector and a male connector locked in place implementing the post method for attaching an earring to an ear.
Figure 7:
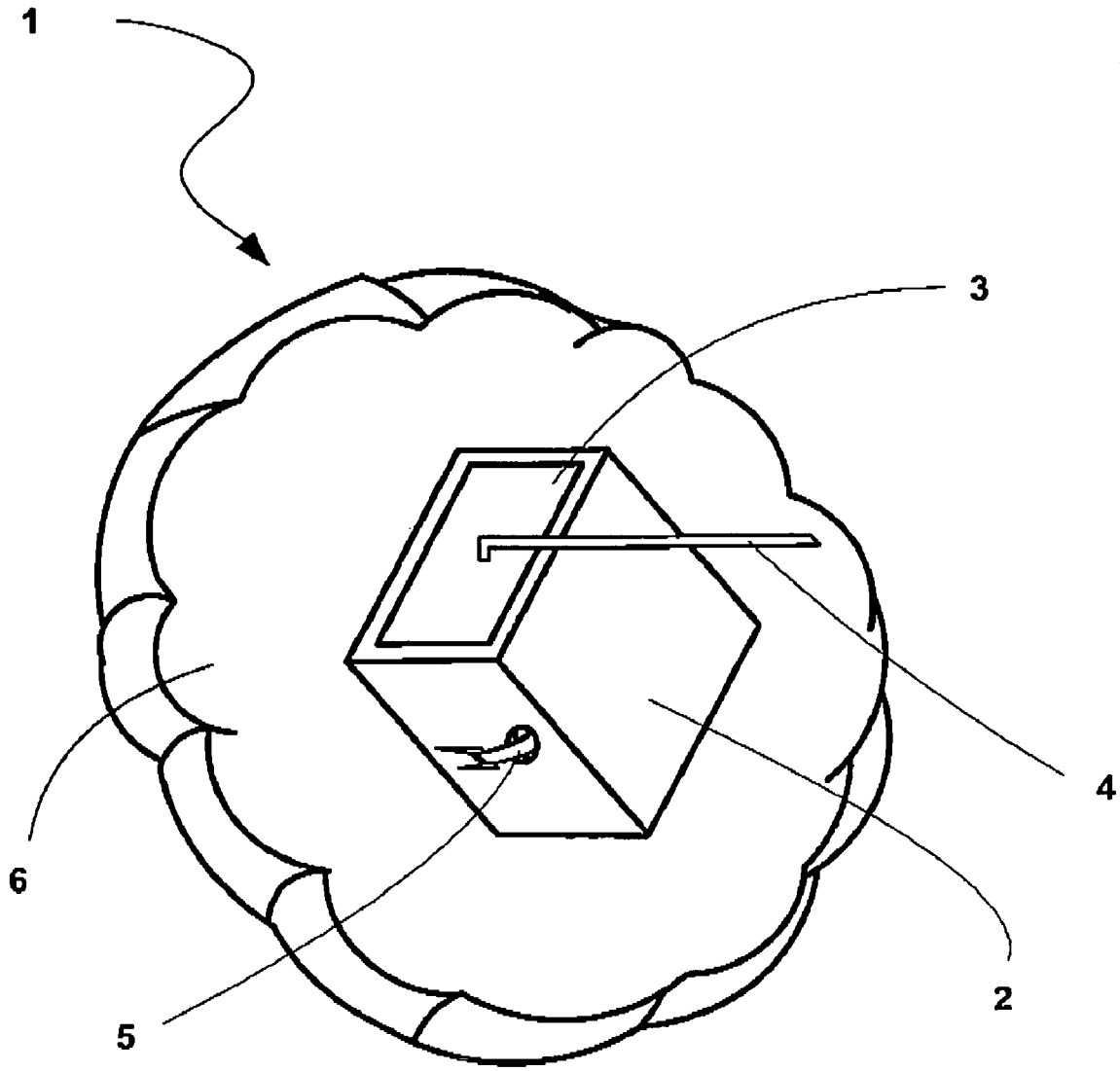
FIG. 7 is a perspective view of a universal female connector and a male connector that implements the post method for attaching an earring to an ear, when the coupling is done parallel to the back of the earring.

Once a male connector is selected to implement a desired attachment method to the ear, this male connector is attached to the universal female connector already attached to the earring as depicted in FIG. 6. FIG. 1 depicts a male (number 11) and a female connector (number 1). To attach the male connector (number 11) to the universal female connector (number 1), align the four sides of the male and female connectors (align number 5 with number 12, number 14 with number 8, number 4 with number 13 and number 9 with number 15. Insert the male connector (sides number 12, 13, 14, and 15) inside the female receptacle until the two holes on each side of the male and female connectors are aligned (hole 6 is aligned with hole 19, hole 4 is aligned with hole on side 13). Then insert the closing pin (numbered 20) starting on the hole (the aligned hole made of number 4 and the hole on side 13) from the opposite side where the closing receptacle (numbered 10) is located and slide said pin across until a portion of said pin is showing outside the hole of the opposite side (align hole of number 6 and 19). With a set of pliers or such instrument, pull the pin (number 20) to make pressure on the whole connector structure and bend said pin downward and away from the top, placing the bended side of said pin inside of the closing receptacle (number 10). Once the pin is inside the closing receptacle, bend the closing receptacle as embracing the pin, and securing its position (depicted in number 5 FIGS. 6 and 7).

The disclosure of the invention described herein-above represents the preferred embodiment of the invention; however, variations thereof, in the form, construction, and arrangement of the component thereof and the modified application of the invention are possible without departing from the spirit and scope of the appended claim.

I claim:

1. A device for setting different ear attachments on earrings comprising of:

a female connector and a plurality of removable and selectable male connectors, where each of said male connectors possesses a different mechanism for attaching said earring to an ear;

wherein said female connector is comprised of a side that is attached to a side of an earring, and a female receptacle, said female receptacle having only a single entry for receiving one of the selectable male connectors, each of said male connectors being complementary shaped to a shape of said female receptacle, such that the selectable male connector is received into said single entry of the female receptacle of the female connector; and a mechanism to lock in place said male connector to said female connector;

wherein said locking mechanism comprises of two holes of similar size and shape in both said male and female connectors, each hole of said two holes located in opposite walls of both said female and male connectors, said holes of female connector matching orientation and location to the holes in said male connector when male connector is inserted into said female receptacle of said female connector; and a pin that after being inserted through said matching holes in the female connector and said male connector is bent at its ends to lock in place said male connector within said female receptacle of said female connector.

2. The ear attachment of claim 1 wherein the single entry of the female receptacle is perpendicular to said side that attaches to an earring.

3. The ear attachment of claim 1 wherein the single entry of the female receptacle is parallel to said side that attaches to an earring.

* * * * *